US006309316B1

(12) United States Patent
Spiegel

(10) Patent No.: US 6,309,316 B1
(45) Date of Patent: Oct. 30, 2001

(54) FOOTBALL TEE WITH ONSIDE KICK BALL SUPPORT

(75) Inventor: H. Jay Spiegel, Mount Vernon, VA (US)

(73) Assignee: Premium Products, Inc., VA (US)

( * ) Notice: Subject to any disclaimer, the term of this patent is extended or adjusted under 35 U.S.C. 154(b) by 0 days.

(21) Appl. No.: 09/476,785

(22) Filed: Dec. 30, 1999

(51) Int. Cl.[7] ..... A63B 71/00; A63B 69/00
(52) U.S. Cl. ..... 473/420
(58) Field of Search ..... 273/317.5; 473/420, 473/387

(56) References Cited

U.S. PATENT DOCUMENTS

| | | | | |
|---|---|---|---|---|
| D. 275,303 | * | 8/1984 | Box | D21/716 |
| D. 291,714 | | 9/1987 | Spiegel . | |
| D. 305,448 | | 1/1990 | Spiegel . | |
| D. 372,062 | | 7/1996 | Spiegel . | |
| D. 383,816 | | 9/1997 | Spiegel . | |
| D. 383,817 | | 9/1997 | Spiegel . | |
| D. 391,275 | | 2/1998 | Spiegel . | |
| D. 392,705 | | 3/1998 | Spiegel . | |
| 3,309,087 | * | 3/1967 | Cullity | 473/420 |
| 3,481,602 | * | 12/1969 | Tatter | 473/420 |
| 4,655,453 | | 4/1987 | Spiegel et al. . | |
| 4,657,252 | | 4/1987 | Spiegel . | |
| 5,100,135 | * | 3/1992 | Bourgeois | 473/420 |
| 5,613,678 | * | 3/1997 | McKee et al. | 473/397 |
| 5,961,402 | | 10/1999 | Spiegel . | |

* cited by examiner

*Primary Examiner*—Jeanette Chapman
*Assistant Examiner*—M. Chambers
(74) *Attorney, Agent, or Firm*—H. Jay Spiegel

(57) ABSTRACT

A football tee includes one or two cut-outs in the peripheral surface, each of which is shaped to resemble the outer surface of a football adjacent its tip. Each cut-out is designed to support the football on a ground surface next to the tee to allow a kicker to perform onside kicks. The cut-outs may be formed in a tee having another diverse ball supporting structure or may be the only ball supporting structure of the tee. The tee is preferably molded of rubber or soft plastic.

8 Claims, 3 Drawing Sheets

FOOTBALL TEE WITH ONSIDE KICK BALL SUPPORT

BACKGROUND OF THE INVENTION

The present invention relates to a football tee with onside kick ball support. For deep kickoffs, place kickers prefer a football tee that elevates the bottom tip of football by the highest possible elevation. The kicker strikes the ball on the sweet spot at a location diametrically opposite to the laces of the ball, driving the ball down field, preferably with a lazy backward end-over-end spin. Currently, for colleges and high schools, the National Collegiate Athletic Association (NCAA) and National Federation of State High School Association (NFHS) rules are uniform with one another, allowing a tee of any height so long as the height does not exceed two (2) inches. In the National Football League (NFL), the rules are more strict, requiring the tee to support the ball at precisely an elevation of one (1) inch off the ground surface.

Occasionally, a team trailing on the scoreboard has just scored and is about to take advantage of the opportunity to kick the ball down field. The rules of the NFL, the NCCA and the NFHS are uniform concerning the concept of an "onside kick". From the spot of the kick, once the ball has traveled ten (10) yards down field, anyone on either team may recover the ball and obtain possession. This rule allows the trailing team to take advantage of an opportunity to recover their kickoff and catch up on the scoreboard with the other team.

The onside kick has become an art form in the game of football. As the onside kick is normally carried out, the kicker attempts to kick the football opposite the laces on the top half of the ball so that the ball leaves the kicker's foot with a rapid forward end-over-end spin. Where the technique is properly accomplished, the ball may hop forward a couple of times and then approximately eight to nine yards from the spot of the kick may hop upwardly above the reach of players on the receiving team, thereby making the ball difficult for the receiving team to recover and providing the possibility that the kicking team will recover it.

As the onside kick technique has evolved, kickers have grown to prefer supporting the ball on one of its tips directly on the ground surface itself. However, this technique often fails because no tee has ever been made that has a side surface designed to accommodate such support. The kicker is often required to either use a holder (a teammate holding the ball on the ground) or to support the ball on a tee elevated off the ground making successful onside kicks more difficult to accomplish.

Accordingly, a need has developed for a football tee that includes an outer peripheral surface specifically designed to allow support of a football on a ground surface using a peripheral edge of the tee for such support.

Applicant is co-inventor of the football tee disclosed and claimed in U.S. Pat. No. 4,655,453, granted on Apr. 7, 1987, and is the sole inventor of the football tees disclosed and claimed in the following U.S. Patents:

| U.S. Pat. No. | Date of Patent |
|---|---|
| 4,657,252 | April 14, 1987 |
| D 305,448 | January 9, 1990 |
| D 291,714 | September 1, 1987 |

-continued

| U.S. Pat. No. | Date of Patent |
|---|---|
| D 392,705 | March 24, 1998 |
| D 372,062 | July 23, 1996 |
| D 383,816 | September 16, 1997 |
| D 383,817 | September 16, 1997 |
| D 391,275 | February 24, 1998 |
| 5,961,402 | October 5, 1999. |

None of these patents teaches or suggests a football tee having an outer peripheral surface designed to support a football on a ground surface.

The present invention constitutes an improvement over the tee disclosed in U.S. Pat. No. D 383,816. Versions of this tee have been marketed under the Trademark TOE-TAL® and GROUND ZERO® and are becoming more and more popular in high schools and colleges throughout the United States. In the National Football League, in the 1999–2000 season, of 31 teams, 28 used the GROUND ZERO® tee.

SUMMARY OF THE INVENTION

The present invention relates to a football tee with onside kick ball support. The present invention includes the following interrelated objects, aspects and features:

(1) In the preferred embodiment of the present invention, the present invention constitutes an improvement over a tee marketed by Applicant's company PREMIUM PRODUCTS, INC. via an exclusive distributor, which tee is known as the GROUND ZERO® tee. The GROUND ZERO® tee is sold in two versions, each of which is a one-piece molded rubber tee. The GROUND ZERO® 1 tee elevates the football one inch off the ground and the GROUND ZERO® 2 tee elevates the football two inches off the ground. The present invention actually improves upon the GROUND ZERO® 1 tee.

(2) The GROUND ZERO® 1 tee includes peripheral ramp surfaces leading up to a top surface in which are provided two adjacent recesses, one of which supports the tip of a football and the other of which permits the tip of the football to leave the first-mentioned recess when kicked. This configuration of recesses is disclosed in the prior art listed above. The present invention is equally usable with a football tee having a different manner of ball support than the two recess structure. Tees using prongs or other means for ball support could also be improved by the present invention.

(3) The present invention preferably consists of providing two cut-outs in the peripheral surface of the tee, one to the left of a centerline of the tee and the other symmetrically to the right of the centerline. Each cut-out is shaped to resemble an outer surface of a football adjacent the tip thereof. At minimum, the top edge of each cut-out should mimic the outer periphery of a football at that elevation off the ground so that the football can be supported with, at minimum, a line contact along that top surface. The rest of the cut-out can be made either in conformance with the outer surface of a football or relieved from that configuration so as to avoid obstructing the position of the football adjacent the tee.

(4) Two cut-outs are provided, in the preferred embodiment, so that the tee may easily be used for onside kicks by kickers who kick with their left or right foot, as the case may be. Of course, if desired, a single recess could be provided, either directly at the forward end of the tee or on one side or the other since the kicker may suitably rotate the tee to aim the ball in the desired direction.

(5) If desired, the cut-outs may be provided in a slab of material that is devoid of any other ball support. However, preferably, the cut-outs are incorporated in a slab having other ball supporting means to increase tee versatility and avoid duplication of items in a kicker's equipment bag.

As such, it is a first object of the present invention to provide a football tee with onside kick ball support.

It is a further object of the present invention to provide such a football tee in which one or two cut-outs are provided on the periphery of the tee surface permitting the kicker to lean the football against the tee while supporting the football on a ground surface.

It is a still further object of the present invention to provide one or two cut-outs on a tee devoid of any other ball support.

It is a still further object of the present invention to provide such a tee with one or two cut-outs where the tee has some other ball supporting means.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
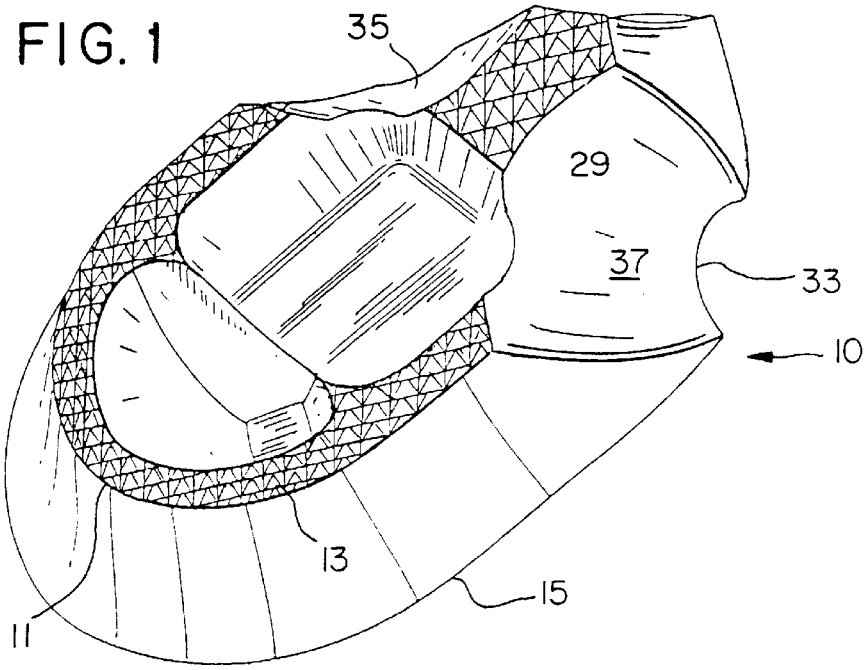
FIG. 1 shows a perspective view of a preferred embodiment of the present invention.
Figure 2:
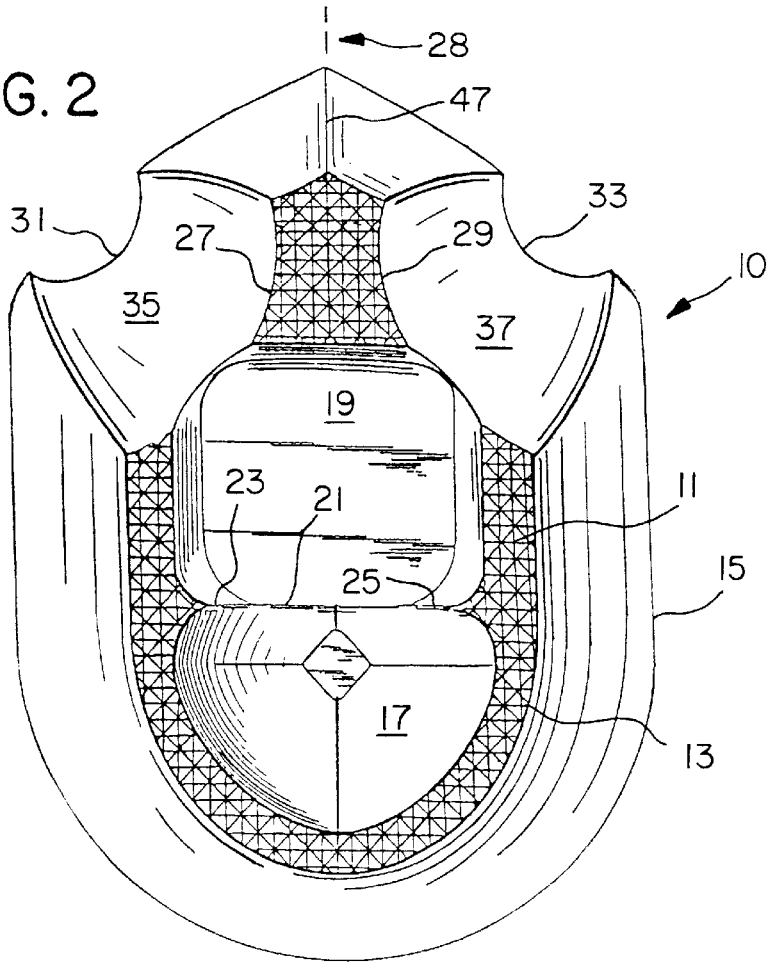
FIG. 2 shows a top view thereof.

With reference, first, to FIGS. 1 and 2, the present invention is generally designated by the reference numeral 10 and is seen to include a top surface 11 defined by a peripheral edge 13 and a bottom edge 15. In the tee shown, a first recess 17 is formed in the top surface 11 and, adjacent thereto, a second recess 19 is provided. The opening 21 between the recesses 17 and 19 includes two laterally inwardly extending ribs 23 and 25. These details are already well known.

The top edge 13 of the tee 10 includes two concave edges 27 and 29 symmetrically disposed to either side of a centerline 28 of the tee. The tee 10 typically has a thickness from the top surface 11 to the bottom edge 15 of approximately 1⅝ inches. The depth of the recess 17 is ⅝ inch, thereby providing one inch of ball elevation. The edges 27 and 29 are configured to match the outer peripheral shape of a football supported in close to straight up and down position adjacent the tee 10 so that the edge 27 or 29 contacts the football surface.

The bottom edge 15 of the tee 10 includes two concave edges 31 and 33 with the edge 31 being located below the edge 27 and with the edge 33 being located below the edge 29. Each of the edges 31 and 33 is provided with a shape designed to resemble the shape of the side edge of the tip of a football.

Between the edges 27 and 31, a surface 35 is provided. Between the edges 29 and 33, a surface 37 is provided. Each of the surfaces 35 and 37 may, in the preferred embodiment, mimic the outer configuration of a football adjacent the tip thereof so that when a football is supported adjacent the tee 10, using either the surface 35 or 37, the surface 35 or 37 engages the ball surface with a full or substantially full surface-to-surface contact to enhance support.

Alternatively, the surfaces 35 and 37 may define a shape larger than the surface defined by a football so that when a football is leaned against the edge 27 or 29, the surface 35 or 37 does not engage the football at all. In such a configuration, the sole supporting portion of the tee would be the edge 27 or 29 engaging the surface of a football with a line contact.

Figure 6:
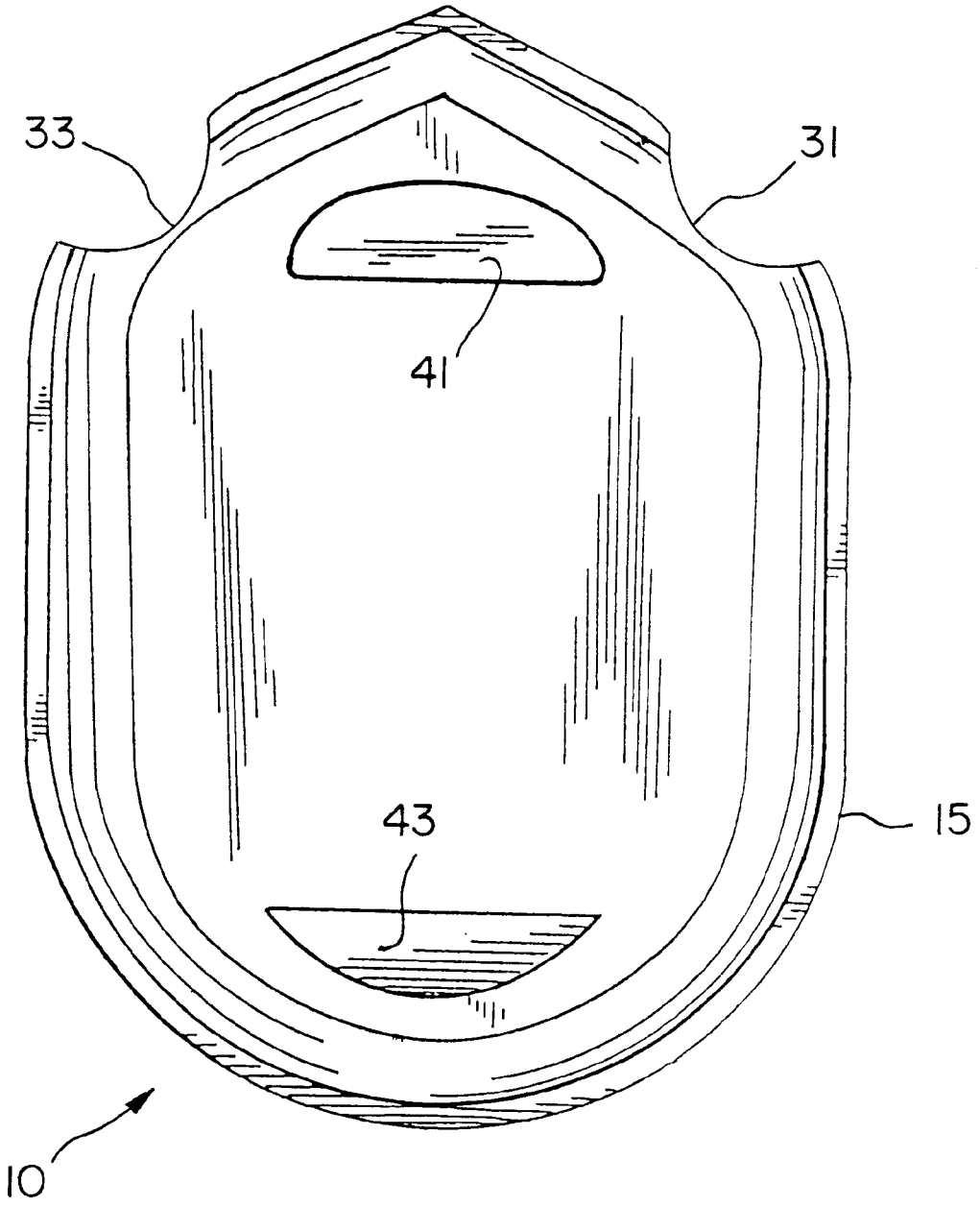
FIG. 6 shows a bottom view thereof.

With reference to FIG. 6, recesses 41 and 43 are provided within the tee to help facilitate uniform vulcanization during the molding process.

Figure 3:
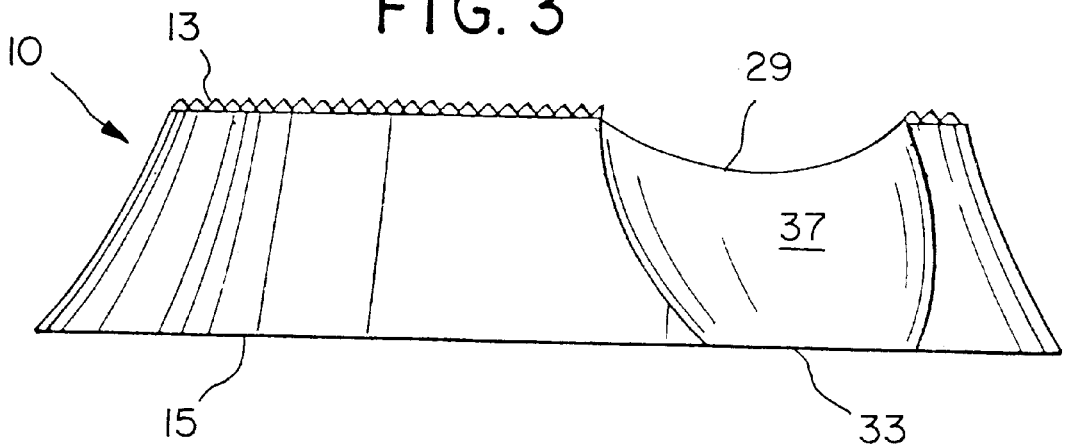
FIG. 3 shows a side view thereof.
Figure 4:
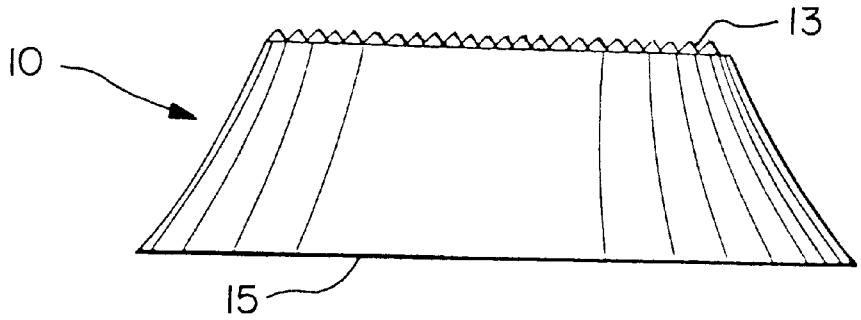
FIG. 4 shows a rear view thereof.
Figure 5:
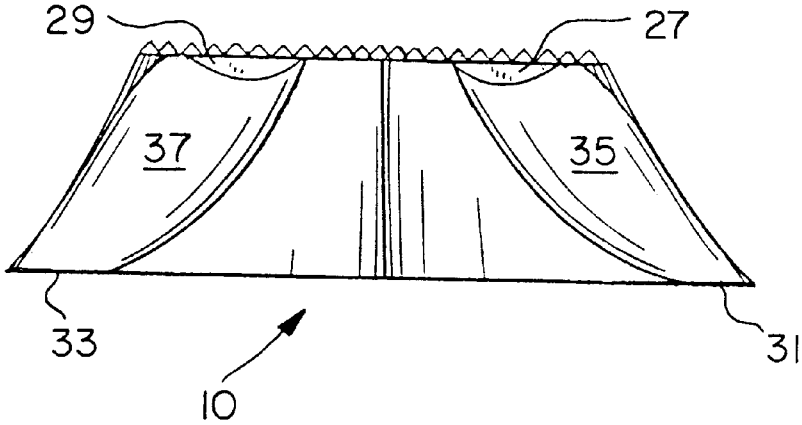
FIG. 5 shows a front view thereof.

FIGS. 3, 4 and 5 show various details of the surfaces 35, 37, the edges 27, 29, 31 and 33, as well as the edges 13 and 15.

In the preferred embodiment, the inventive tee is made of vulcanized rubber in a pressure molding process. Of course, if desired, the tee could be made of a plastic material exhibiting some degree of resiliency.

While the tee is shown having two surfaces 35, 37 and their associated edges, if desired, a single such surface with associated edges could, instead, be provided, at one or the other of the locations shown in particular in the figures, or, alternatively, at the location of the front edge 47 aligned with the axis of elongation 28. In the configuration shown, in particular, in FIG. 2, the edges 27, 31 and surface 35 are best used by a right-footed kicker and the edges 29, 33 and surface 37 are best used by a left-footed kicker. Of course, if only one surface and set of edges is provided, the tee may be suitably twisted and aligned on the ground to align the surface and edges with the desired direction of travel of the football.

As such, an invention has been disclosed in terms of preferred embodiments thereof which fulfill each and every one of the objects of the invention as set forth hereinabove, and provide a new and useful football tee with onside kick ball support of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A football tee, comprising:

a) a body supportable on a ground surface;

b) said body having a top outer peripheral edge spaced from said ground surface;

c) said top outer peripheral edge having a recess depending therefrom shaped generally in conformance with a portion of a tip of a football, wherein a football is supported by said tee enabling said tip of said football to engage a ground surface in a substantially upright configuration with said recess engaged by said football.

2. The tee of claim 1, further including a bottom peripheral edge, said top and bottom edges having concave edge portions shaped in general conformance with respective side edges of a tip of a football.

3. The tee of claim 1, further including a top surface with support means for supporting a football at an elevation above a ground surface.

4. The tee of claim 1, further including a further said concave edge portion whereby a football may be supported in either one of two locations adjacent said tee.

5. In a football tee including a means for supporting said tee on a ground surface, a surface spaced from said supporting means and means associated with said surface for supporting a football with a tip thereof spaced above a ground surface, the improvement comprising:

a) said surface having an outer peripheral edge;

b) a concave edge portion in said outer peripheral edge shaped generally in conformance with a portion of an outer surface of a football, and a recess depending from said concave edge portion, said recess shaped in general conformance with a portion of a tip of said football, wherein a football is supported by said tee enabling a tip of said football to engage a ground surface in an upright configuration with said concave edge portion and recess engaged by a portion of said tip of said football.

6. The tee of claim 5, wherein said means for supporting said tee comprises a bottom peripheral edge, said bottom peripheral edge having a further concave edge portion below said recess, said further concave edge portion shaped in general conformance with a side edge of a tip of a football.

7. The tee of claim 5, further including a further said concave edge portion whereby a football may be supported in either one of two locations adjacent said tee.

8. The tee of claim 5, made of molded rubber.

* * * * *